US006131356A

United States Patent [19]

Gieseke

[11] Patent Number: 6,131,356

[45] Date of Patent: Oct. 17, 2000

[54] MUNTIN BAR CLIP

[76] Inventor: Gerald G. Gieseke, 180 Section 1 Rd., Tieton, Wash. 98947

[21] Appl. No.: 09/231,908

[22] Filed: Jan. 14, 1999

[51] Int. Cl.[7] ..... E04C 2/38

[52] U.S. Cl. ..... 52/656.5; 52/456; 52/507; 52/668; 52/766

[58] Field of Search ..... 52/656.8, 656.5, 52/456, 507, 668, 766

[56] References Cited

U.S. PATENT DOCUMENTS

| | | | |
|---|---|---|---|
| 3,099,865 | 8/1963 | Burnett . | |
| 3,108,336 | 10/1963 | Tate . | |
| 3,293,817 | 12/1966 | MacGregor . | |
| 3,307,316 | 3/1967 | Gray . | |
| 3,340,661 | 9/1967 | Krieger . | |
| 3,372,522 | 3/1968 | Engstrom | 52/456 |
| 3,381,431 | 5/1968 | Jacobson | 52/309.1 |
| 3,504,468 | 4/1970 | Martin | 52/204.61 |
| 3,645,058 | 2/1972 | Jacobson . | |
| 3,686,814 | 8/1972 | Anderson . | |
| 3,791,095 | 2/1974 | Martin . | |
| 4,060,950 | 12/1977 | Rackard . | |
| 4,437,284 | 3/1984 | Cribben . | |
| 4,644,721 | 2/1987 | Bloomquist . | |
| 4,890,435 | 1/1990 | Wilkening . | |
| 4,949,521 | 8/1990 | Riegelman . | |
| 4,970,840 | 11/1990 | Ouellett . | |
| 4,989,384 | 2/1991 | Kinghorn . | |
| 5,048,252 | 9/1991 | Osborn . | |
| 5,154,034 | 10/1992 | Stanek . | |
| 5,313,761 | 5/1994 | Leopold . | |
| 5,325,579 | 7/1994 | Baier . | |
| 5,363,625 | 11/1994 | Philippi . | |
| 5,574,651 | 11/1996 | McKeegan . | |
| 5,678,376 | 10/1997 | Poma . | |
| 5,678,377 | 10/1997 | Leopold . | |

*Primary Examiner*—Christopher T. Kent
*Assistant Examiner*—Jennifer I. Thissell
*Attorney, Agent, or Firm*—Liebler, Ivey & Connor; Floyd E. Ivey

[57] ABSTRACT

An apparatus of a muntin bar clip to secure the position of muntin bars during and following the fabrication of multi-pane sealed glass window units. The disclosure relates to securing and positioning muntin bars at multi-pane sealed glass window unit perimeters and in joining hollow false muntin bars within such units. The invention relates particularly to muntin bar clips intended to fix the position of hollow false muntin bars at the perimeter of the window unit utilizing the sealing methods including foam strips and or butyl as the sealing medium. The disclosed invention more particularly relates to muntin bar clips for the purpose of fixing the position of hollow false muntin bars at the perimeter of the window unit where the false muntin bar is other than orthogonal in relation to the perimeter of the window. The invention more specifically provides the fixing of the position of muntin bars to lessen the likelihood of either breaking or cracking the glass panes, as multi-pane sealed unit assembly occurs, or of causing seal failure of such units either during manufacture or following installation.

16 Claims, 8 Drawing Sheets

MUNTIN BAR CLIP

FIELD OF THE INVENTION

The present invention relates generally to an apparatus of a muntin bar clip to secure the position of muntin bars during and following the fabrication of multi-pane sealed glass window units. The disclosure relates to securing and positioning muntin bars at multi-pane sealed glass window unit perimeters and in joining hollow false muntin bars within such units. The invention relates particularly to muntin bar clips intended to fix the position of hollow false muntin bars at the perimeter of the window unit utilizing the sealing methods including foam strips and/or butyl as the sealing medium. The disclosed invention more particularly relates to muntin bar clips for the purpose of fixing the position of hollow false muntin bars at the perimeter of the window unit where the false muntin bar is other than orthogonal in relation to the perimeter of the window. The invention more specifically provides the fixing of the position of muntin bars to lessen the likelihood of either breaking or cracking the glass panes, as multi-pane sealed unit assembly occurs, or of causing seal failure of such units either during manufacture or following installation.

BACKGROUND OF THE INVENTION

Sealed multi-pane sealed window units have become standards for new and renovation construction within industrialized nations. Architectural detail is provided by the fixing of false muntin bars between panes of glass within such units. Such detail frequently requires multiple false muntin bars to intersect to form distinct patterns within the unit. The positioning of muntin bars commonly results in muntin bar ends intersecting with the perimeter of a window unit in other than an orthogonal relationship between the muntin bar and the unit perimeter forming, for example, a sunburst or radiating pattern. The securing of muntin bars in place during and following manufacture is critical in that any shifting from proper alignment will result in an unacceptable appearance. The method of or apparatus securing muntin bars, at the perimeter of such units, must not interfere with the sealing method of the unit. A method of fixing the position of muntin bars at a window unit perimeter has included the fixing of a pin at the muntin bar end with the pin to be received into a hole prepared in the window unit perimeter at the frame. The pin and hole combination required additional manufacturing steps and, in the case of sealed units, created potential sealant breaches.

The advent of new manufacturing techniques and the production of foam strip sealed and butyl sealed inert gas filled window units renders problematic or unusable methods of apparatus, for the positioning of muntin bars, disclosed in the prior art. Maintenance of gas integrity within such units is of paramount importance in insuring continued heat exchange properties and eliminating the potential for formation of condensation within the interior of the unit. Existing prior art is unlikely to provide for the maintenance of such characteristics with a substantial likelihood that the interior of sealed units will experience a breach of the seal. The apparatus disclosed herein is principally adapted for use with foam strip, butyl and other similar pliable or flexible seal systems.

Prior art which is distinguished includes the following which, along with additional patents, are disclosed in an information disclosure statement. U.S. Pat. No. 3,686,814 to Anderson discloses a barbed clip for use with wood frames and a clip suitable for locking behind a bead on a metal window frame. U.S. Pat. No. 4,644,721 to Bloomquist et al. relates to a clip for securing a muntin bar in a single pane window for ease of removal of the muntin bar for cleaning purposes. U.S. Pat. No. 4,890,435 to Wilkening et al. demonstrates a method of mounting muntin bars on the exterior of a multi-pane unit. U.S. Pat. No. 4,060,950 to Rackard et al. discloses a clip for the interconnection of muntin bars at their point of crossing. U.S. Pat. No. 5,574,651 to McKeegan et al. discloses a keeper at the end of a muntin bar having a protrusion secured within an aperture within the frame. U.S. Pat. No. 3,108,336 to Tate demonstrates an end clip limited to an orthogonal orientation. U.S. Pat. No. 5,154,034 to Stanek shows an edge clip with a pad form element in contact with the seal material causing a pressure point break of the seal integrity with the window perimeter. U.S. Pat. No. 3,791,095 to Martin illustrates edge clips with a semi-circular edge sized to fit within one-sixteenth inch bores in the spacing strips. U.S. Pat. No. 5,678,376 to Poma demonstrates edge clips with protrusions received into apertures in the frame. U.S. Pat. No. 5,325,579 to Baier shows a multi-pane structure with a muntin bar grid. U.S. Pat. No. 4,437,284 to Cribben et al. shows muntin bars fixed with pins at the frame. U.S. Pat. No. 3,307,316 to Gray shows a pin fixing method at the frame. U.S. Pat. No. 4,989,384 to Kinghorn et al. illustrates a locating pin received in an opening in the perimeter bar. U.S. Pat. No. 3,645,058 to Jacobson discloses muntin bars with cam or wedge locking with a window sash. U.S. Pat. No. 3,340,661 to Krieger illustrates an edge clip composed of a tongue member received into a slot and a toothed member engaging a wood sash frame member. U.S. Pat. No. 4,949,521 to Riegelman et al. disclosed external muntin bars affixed with screw means. U.S. Pat. No. 4,970,840 to Ouellette et al. discloses a muntin end piece bearing a stud which snap fits into a hollow of the sash. U.S. Pat. No. 3,099,865 to Burnett demonstrates a magnetic pin means of securing muntin bars in place. U.S. Pat. No. 5,363,625 to Philippi shows a structural framework having end portions fixed in place by posts received into sockets. U.S. Pat. Nos. 5,313,761 and 5,678,377 to Leopold shows an edge clip having fingers received into a hollow muntin bar and secured a sash by laches received through apertures in the sash. U.S. Pat. No. 5,048,252 to Osborn illustrates muntin bars fixed with cam locks. U.S. Pat. No. 3,293,817 to MacGregor shows muntin bars fixed by a stud, at the sash, received into a slot in the muntin bar. The patents referred to herein are provided herewith in an Information Disclosure Statement in accordance with 37 CFR 1.97.

SUMMARY OF THE INVENTION

The present invention discloses a muntin bar clip having a post, which is received into and friction secured into a hollow muntin, and a tip, distal from the post, terminating in a tip end with either a blunt end or prongs. Alternative to the use of the invention with the hollow muntin is the use with a hub where the muntin bar clip is received into a slot or other connection means of a hub where the hub provides muntin bar connection means receiving muntin bar clip means which is in turn secured into a hollow muntin. The muntin bar clip disclosed herein is directed particularly to use with the multi-pane sealed unit. Several methods are utilized to seal multi-pane sealed window units including the use of hollow metal spacer bars having a butyl bead contacting each pane, as a primary sealing means, and generally a butyl outer seal in contact with each pane and the metal spacer bar separating the panes; this process may be known as a G.E.D. system. A second process of sealing is the use of a solid butyl strip spaced between panes with a metal strip; the butyl strip used in this process is known as a swiggle strip. A third method of sealing multi-pane sealed window units is the use of an inner foam strip having an outer adhesive seal; this method may be known as a super spacer. The multi-pane construction is accomplished with the intent of providing a sealed unit capable of maintaining the sealed integrity during manufacture through shipping, installation and finally use over the years following installation.

Multi-pane construction generally includes positioning of muntin bars, between window panes, for architectural detail. Hollow false muntin bars facilitate the formation of patterns desired by the consumer. Muntin bars are interconnected within the unit, for pattern formation, and positioned at the edge of the window unit with muntin bar clips. The post of a muntin bar clip is received into the hollow muntin bar end which is either to be joined with other muntin bars for pattern formation or which is to be positioned at the window edge. Where pattern formation is to be achieved the muntin bar clip may have a plurality of posts interconnected with a swivel means. Where a muntin bar is to be positioned at a window unit perimeter the muntin bar clip will have a tip having a tip end, distal from the post, which is received between a pane and the sealing structure or sealing material separating panes in the multi-pane sealed window unit at the perimeter. The prior art demonstrates a variety of means for receiving the clip into a hollow muntin bar and the receipt of a tip, post or pin into a structure at the perimeter of a window unit.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

Figure 1:
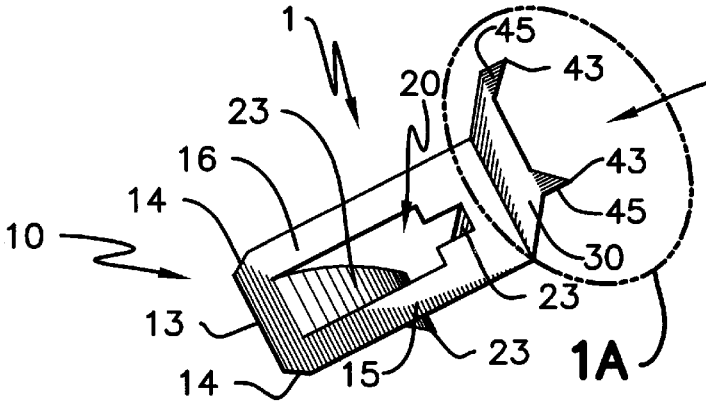
FIG. 1 is a perspective showing the preferred embodiment of a muntin bar clip 1 with a post 10, a post end 13 with post end bevels 14 and a post surface 15 having a first and second side 16, 17; a fastener means 20, formed at the post surface 15 from the first to the second side 16, 17, having one or a plurality of tang springs 23; a tip 40 having a tip end 43 distal from the post end 13 terminating in one or a plurality of prongs 45; an offset 30 formed intermediate the tip 40 and the fastener means 20.

The prior art method of fixing of the muntin bar clip 1 in a multi-pane sealed window unit 70 having a perimeter 72 includes the drilling of holes, in the structure at the perimeter 72, to receive a pin. Disadvantages of this method include the precision which is required in the positioning of the drilling of the hole to insure correct location of the muntin bars in relation to the panes and frame. Additionally, the existence of a drilled hole creates added risk of loss of sealing integrity at the perimeter. Another disadvantage is the prior art frequently demonstrates clips which must be sized for each different size muntin bar.

The preferred embodiment of the present invention seen in FIG. 1, FIG. 1A and FIGS. 5 through 11, is a muntin bar clip 1 with a post 10 having a post end 13 with post end bevels 14 and a post surface 15 having a first and second side 16, 17; a fastener means 20 formed in the post 10 at the post surface 15 from the first to the second side 16, 17. The fastener means 20 formed either as a tang fastener 22 having one or a plurality of tang springs 23, having a spring function realized from the material from which the post 10 is manufactured, formed by a cutting or stamping means of the post surface 15 from the first to the second side 16, 17 or as a dimple 25 formed generally by a stamping means of the post surface 15 by deforming the post surface 15 from the first to the second side 16, 17 forming a dimple 26. The tang springs 23 or the dimple 26, formed into a protrusion, is dimensioned to be friction received tightly into a false hollow muntin bar 65, having ends 68, at the end 68. Fastener means 20 is provided by the tang springs 23, dimple 26 or by other means whereby a structure formed at the post 10 will provide a friction securing function when the post 10 is received into an aperture 66 of a hollow false muntin bar 67 at the end 68.

The muntin bar clip 1 has a tip 40 having tip first and second side 41, 42 and a tip end 43 distal from the post end 13. The tip end 43 may terminate in one or a plurality of prongs 45, or as a blunt end 50 as shown in FIGS. 1, 1A and 2 through 12. The tip end 43 is secured between a pane 71 and the sealing structure wherein the tip end 43 form is selected such as to lessen the likelihood of breaking or cracking a pane 71 or of violating the sealing structure integrity of the multi-pane construction. The tip end 43, generally formed from sheet metal, is dimensioned to provide material strength sufficient to maintain the position of the hollow false muntin bar 65 relative to the perimeter 72 while of a thickness which will not cause breaking of the pane 71 or create a sealing structure 80 leak. In the preferred embodiment the tip end 43 is formed with one or more prongs 45, shown in FIGS. 1 and 1A, which are received between the sealing structure and the pane 71, in the instance of use of the G. E. D. sealing method and alternatively, where other sealing systems are used such as the swiggle strip or super spacer, between the sealing structure and the pane 71 and into the sealing structure material. The tip end 43 with prongs 45 reduce the area of a tip end 43 to be inserted between the sealing structure and the pane 71, thus reducing the potential for breaking or cracking the glass or violation of the seal either during manufacture or during any subsequent phase of the life of a multi-pane unit. In the preferred embodiment a false hollow muntin bar 65, having an end 68, receives at the end 68 the post 10, at the post end 13, of a muntin bar clip 1. Post end bevels 14 facilitate the insertion of the post end 13 into the end 68. The post 10 is dimensioned to be received into the false hollow muntin bar 65 at the end 68 such as to cause a secure friction fit in combination with the dimension of the fastener means 20. The fastener means 20 is dimensioned to further insure a secure friction fit in the false hollow muntin bar 65. The muntin bar clip 1 has an offset 30 formed intermediate the tip 40 and the fastener means 20. The offset 30 is dimensioned to and serves to center and securely position the false hollow muntin bar 65 between the panes 71 when the post 10 is received and secured into the false hollow muntin bar 65 end 68 and the tip end 43 is received between a pane 71 and the sealing structure at the perimeter 72. The preferred embodiment for the muntin bar clip 1 is shown in FIG. 1. In the preferred embodiment the false hollow muntin bar 65 is positioned orthogonally in relation to the perimeter 72.

Figure 2:
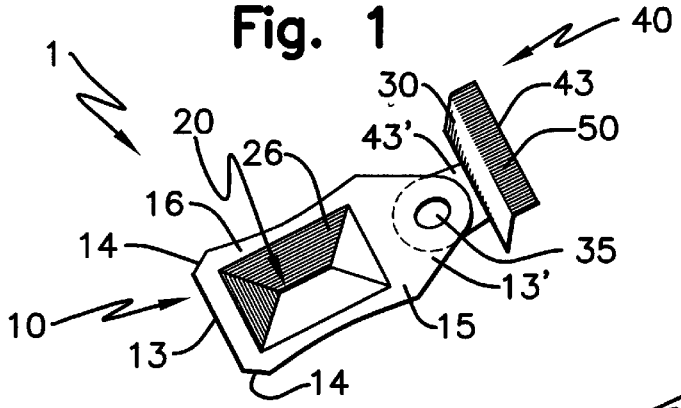
FIG. 2 is a perspective of an alternative embodiment of a muntin bar clip 1 with a post 10, a post end 13 with post end bevels 14 and a post surface 15 having a first and second side 16, 17; a fastener means 20, formed at the post surface 15 from the first to the second side 16, 17, having a dimple 26; a post second end 13' distal from the post end 13; a tip 40 having a tip end 43 distal from the post end 13 terminating in a blunt end 50; the tip 40 has a tip second end 43' distal from the tip end 43. An offset 30 formed intermediate the tip 40 and the tip second end 43'. Connecting means 35 connecting the post 10 and the tip 40 at the post second end 13' and the tip second end 43' such that the post 10 and the tip 40 are rotatably secured by the connecting means which provides a swivel function.
Figure 3:
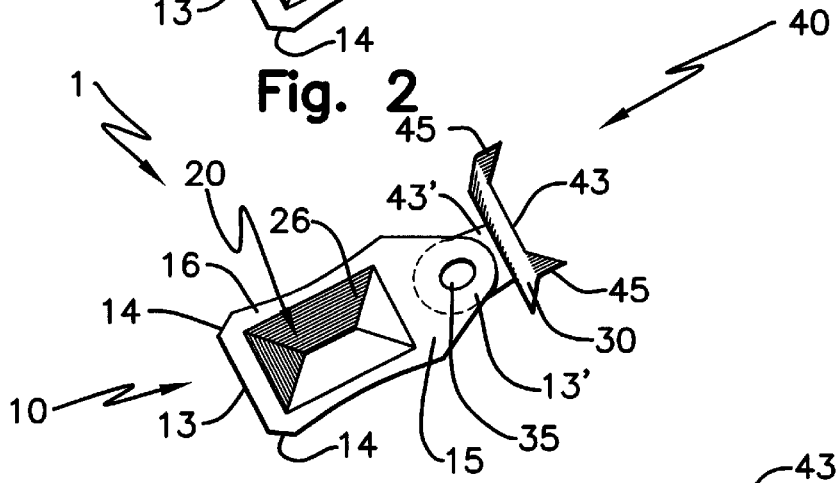
FIG. 3 is a perspective of an additional embodiment of muntin bar clip 1 of FIG. 2 showing the tip 40 with tip end 43 having one or a plurality of prongs 45.
Figure 4:
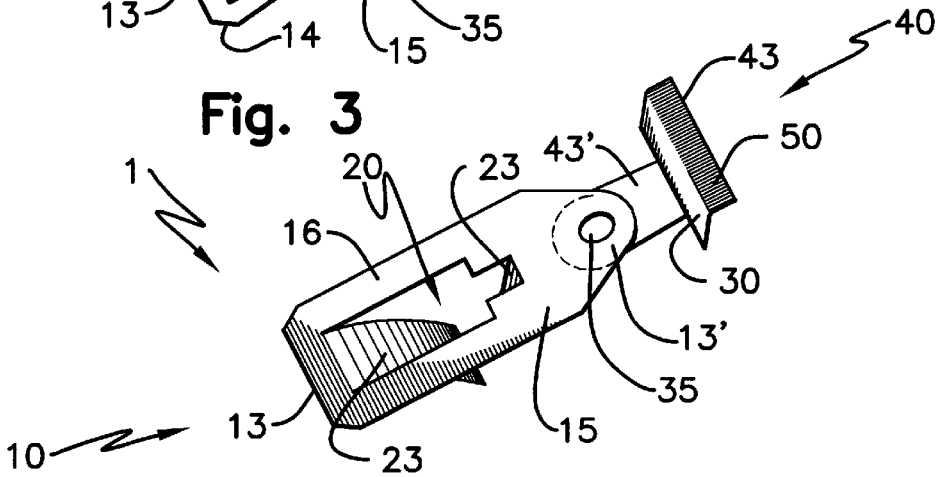
FIG. 4 is a perspective of the muntin bar clip 1 of FIG. 2 showing a fastener means 20 provided by tang springs 23.
Figure 5:
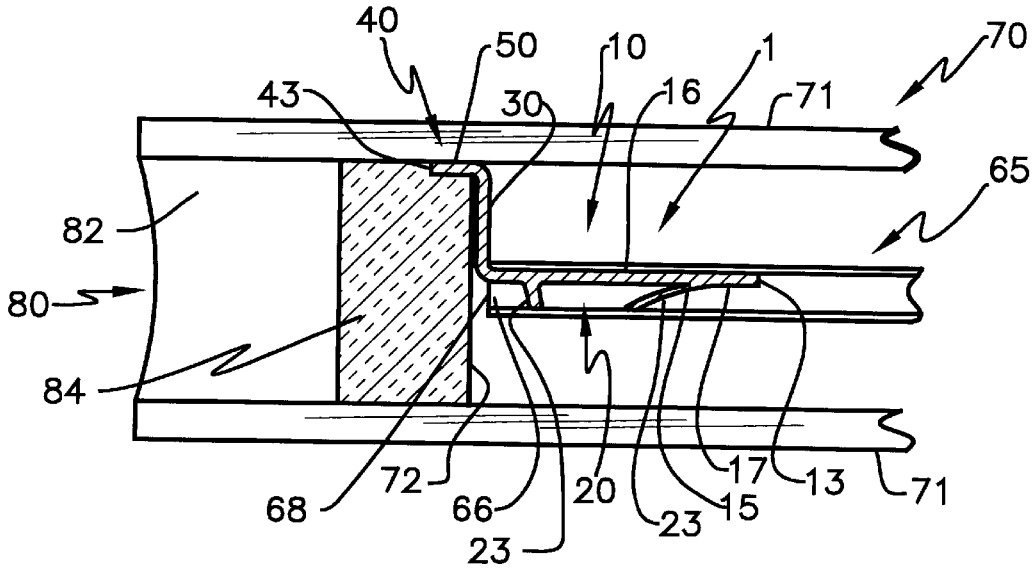
FIG. 5 is a section from a side elevation showing a multi-pane sealed window unit 70 having panes 71, a perimeter 72 and a hollow false muntin bar 65, shown in elevation section, having an aperture 66 and end 68; a muntin bar clip 1 with a post 10, a post end 13 with a post surface 15 having a first and second side 16, 17; a fastener means 20, formed at the post surface 15 from the first to the second side 16, 17, having one or a plurality of tang springs 23; a tip 40 having a tip end 43 distal from the post end 13 terminating in a blunt end 50; an offset 30 formed intermediate the tip 40 and the fastener means 20. Also shown is the sealing structure 80 composed of butyl 82, and a super spacer 84. The blunt end 50 is shown positioned between the pane 71 and super spacer 43 at the perimeter 72.
Figure 6:
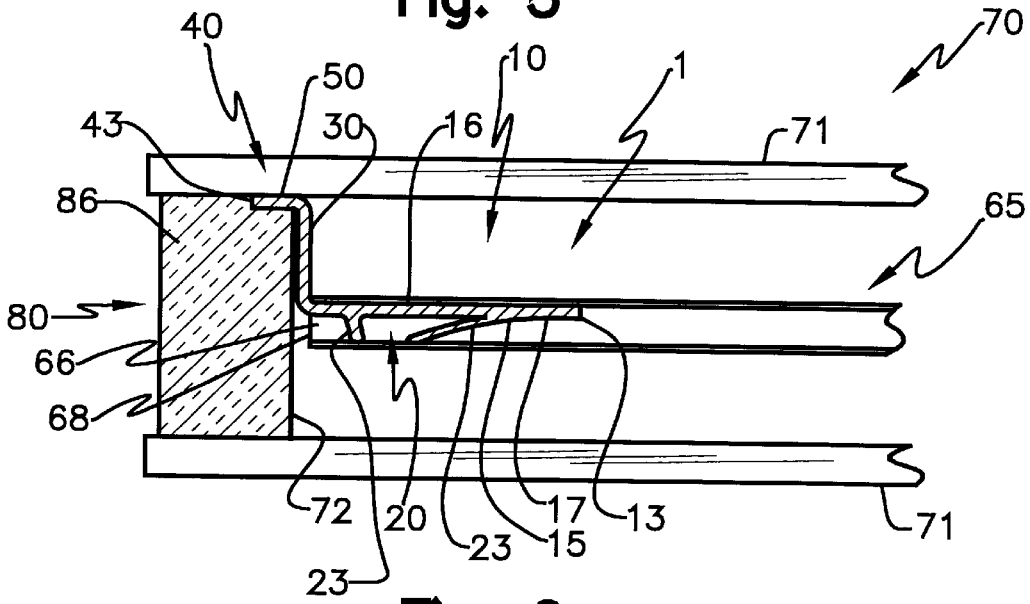
FIG. 6 is a section from a side elevation showing a multi-pane sealed window unit 70 having panes 71, a perimeter 72 and a hollow false muntin bar 65, shown in elevation section, having an aperture 66 and end 68; a muntin bar clip 1 with a post 10, a post end 13 with a post surface 15 having a first and second side 16, 17; a fastener means 20, formed at the post surface 15 from the first to the second side 16, 17, having one or a plurality of tang springs 23; a tip 40 having a tip end 43 distal from the post end 13 terminating in a blunt end 50; an offset 30 formed intermediate the tip 40 and the fastener means 20. Also shown is the sealing structure 80 composed of swiggle strip 86. The blunt end 50 is shown positioned between the pane 71 and swiggle strip 86 at the perimeter 72.
Figure 7:
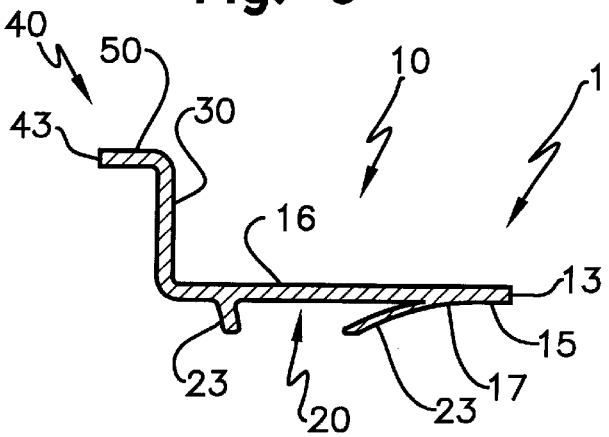
FIG. 7 is side elevation showing a muntin bar clip 1 with a post 10, a post end 13 with a post surface 15 having a first and second side 16, 17; a fastener means 20, formed at the post surface 15 from the first to the second side 16, 17, having one or a plurality of tang springs 23; a tip 40 having a tip end 43 distal from the post end 13 terminating in a blunt end 50; an offset 30 formed intermediate the tip 40 and the fastener means 20.
Figure 8:
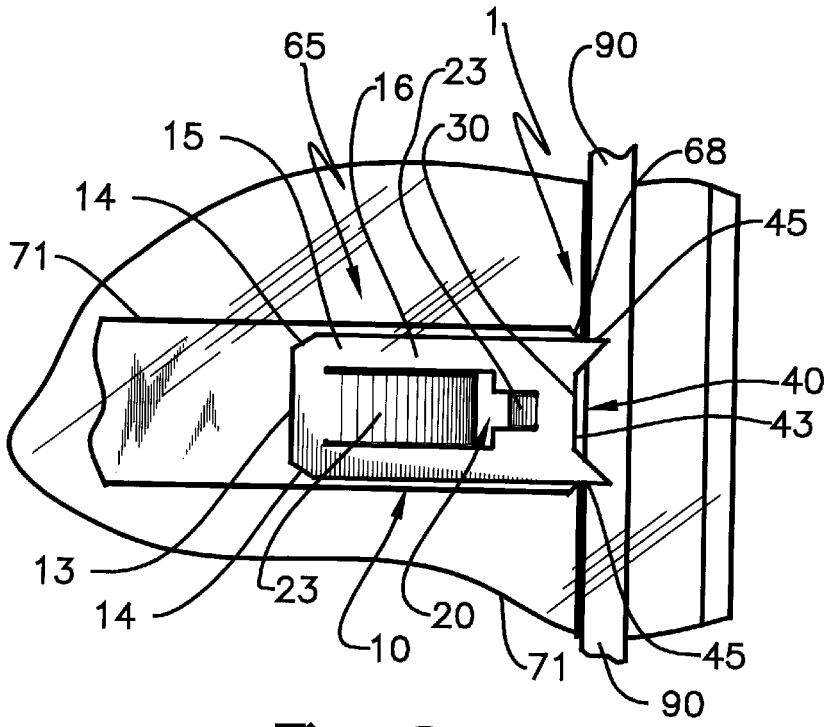
FIG. 8 is a section view of a muntin bar 65 showing a plan view of a muntin bar clip 1. The figure illustrates the use of the invention with a sealant strip 90, composed for example of a butyl bead, showing a muntin bar clip 1 with a post 10, a post end 13 with post end bevels 14 and a post surface 15 having a first and second side 16, 17; a fastener means 20, formed at the post surface 15 from the first to the second side 16, 17, having one or a plurality of tang springs 23; a tip 40 having a tip end 43 distal from the post end 13 terminating in one or a plurality of prongs 45 positioned at the sealant strip 90; an offset 30 formed intermediate the tip 40 and the fastener means 20.
Figure 9:
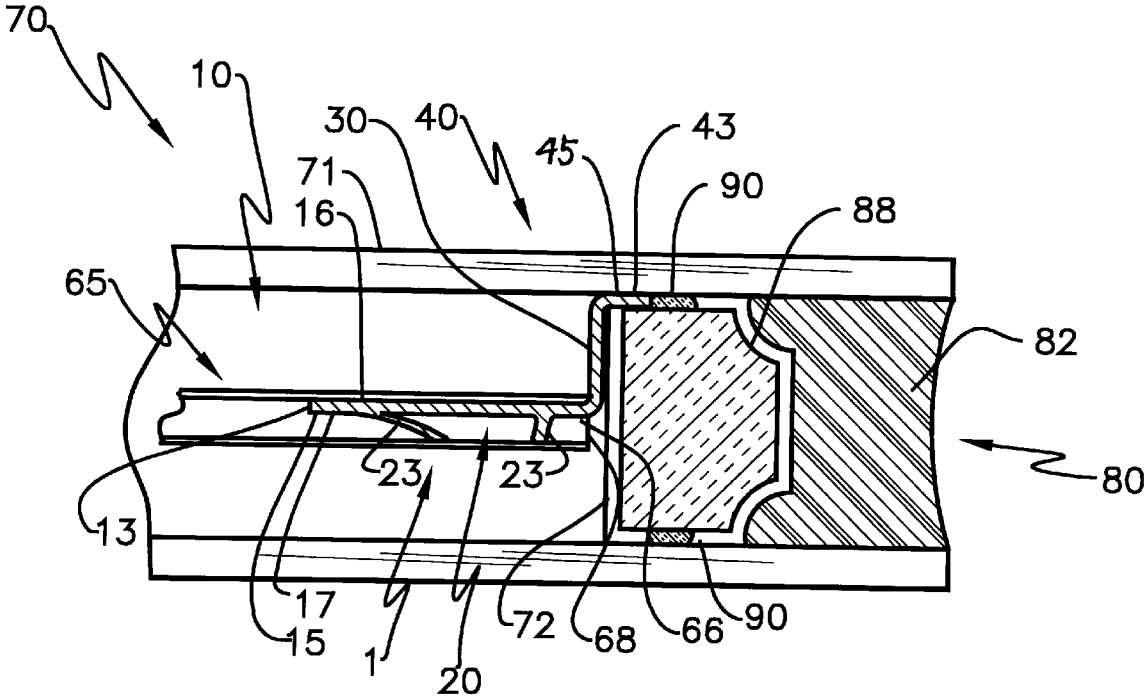
FIG. 9 is a section from a side elevation of the view shown in FIG. 8 showing a muntin bar in elevation section and illustrating a muntin bar clip 1 positioned with sealing structure 80 as butyl 82, is the sealing structure 80 composed of butyl 82 and a formed spacer 88 having sealant strips 90. The tip 40 is shown positioned between the pane 71 and sealant strip 90 at the perimeter 72.
Figure 10:
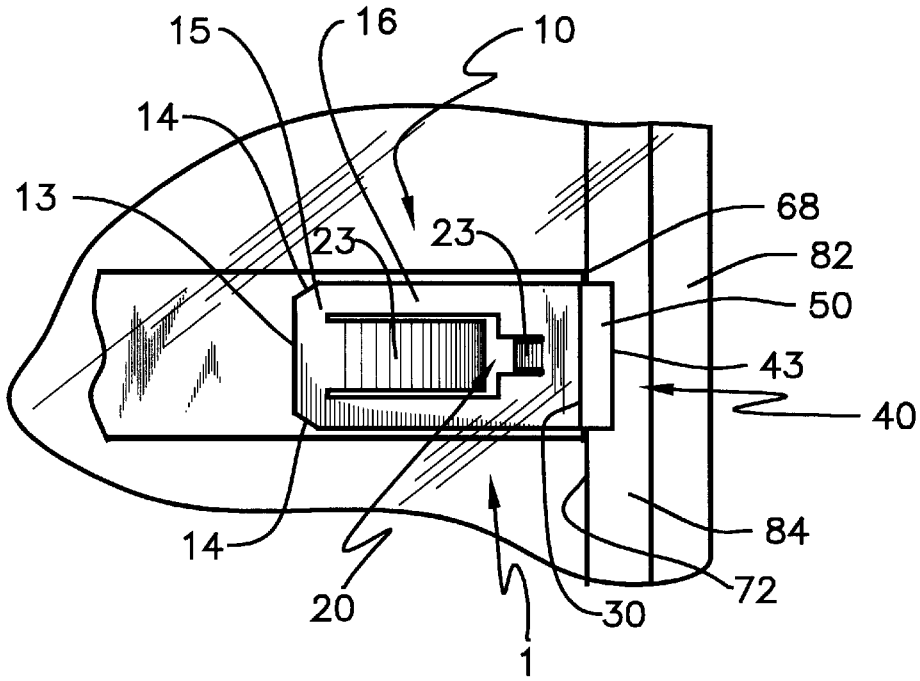
FIG. 10 is a section view of a muntin bar 65 showing a plan view of a muntin bar clip 1. The figure illustrates the use of the invention with a sealing structure 80 comprised of butyl 82, super spacer 84 with the blunt end 50 positioned relative to super spacer 84.
Figure 11:
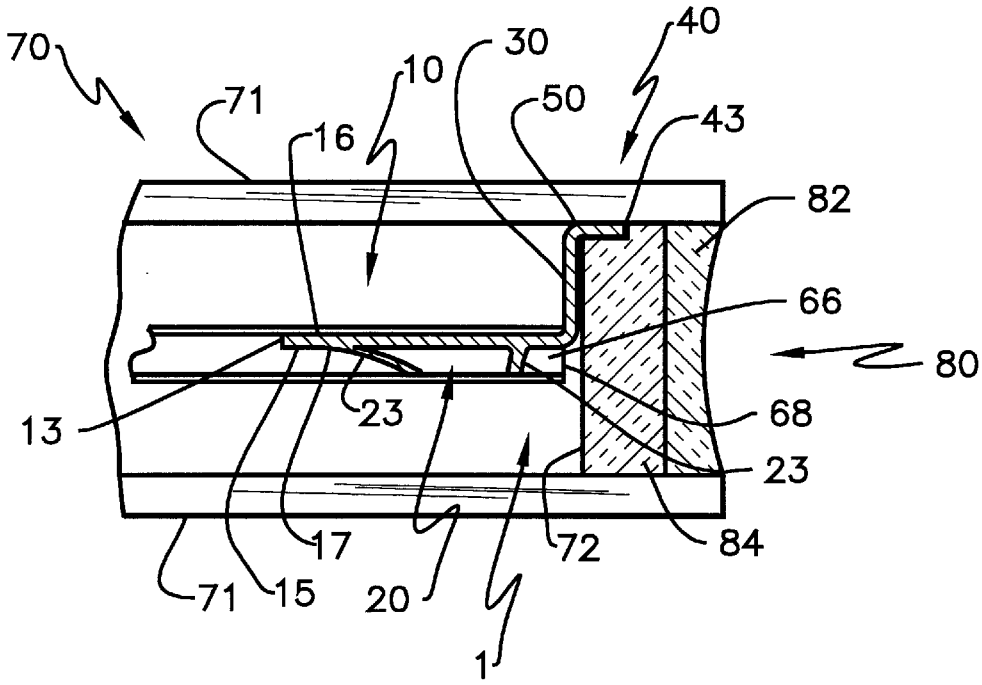
FIG. 11 is a section from a side elevation of the view shown in FIG. 10 showing a muntin bar in elevation section and further illustrating the blunt end 50 positioned between a pane 71 and super spacer 84.

An alternative embodiment of the invention disclosed herein is shown at FIGS. 2, 3 and 4 wherein muntin bar clip 1 is utilized for the positioning of false hollow muntin bars 65 where the false hollow muntin bar 65 will be orthogonal or other than orthogonal relative to the perimeter 72. Where the positioning of the false hollow muntin bar 65 will be other than orthogonal relative to the perimeter 72 the post 10 will be fastened by connecting means including swivel means to the tip 40. Where connecting means 35 is utilized, the post 10 has a post second end 13' distal from the post end 13 and the tip 40 has a tip second end 43' distal from the tip end 43 and distal from the offset 30. The offset 30 is intermediate the tip end 43 and the tip second end 43'. The connecting means 35 is positioned intermediate the post second end 13' and the fastener means 20 and the tip second end 43' and the offset 30 such that the post 10 and the tip 40 are secured together. The connecting means 35 may be a swivel means such that the post 10 and tip 40 rotate around the connecting means 35. The connecting means 35 may be a rivet providing a swivel function. Where a pattern is to be formed via interconnection of false hollow muntin bars 65 a plurality of posts 10 are interconnected by connecting means 35 including swivel means. The interconnection is positioned intermediate the fastener means 20 and the post second end 13'. The fastener means 20 is intermediate the post end 13 and post second end 13'. Connecting means 35 may be by swivel means. Connecting means 35 may be, for example, with a rivet and may be formed during a stamping process of the muntin bar clip 1.

Figure 12:
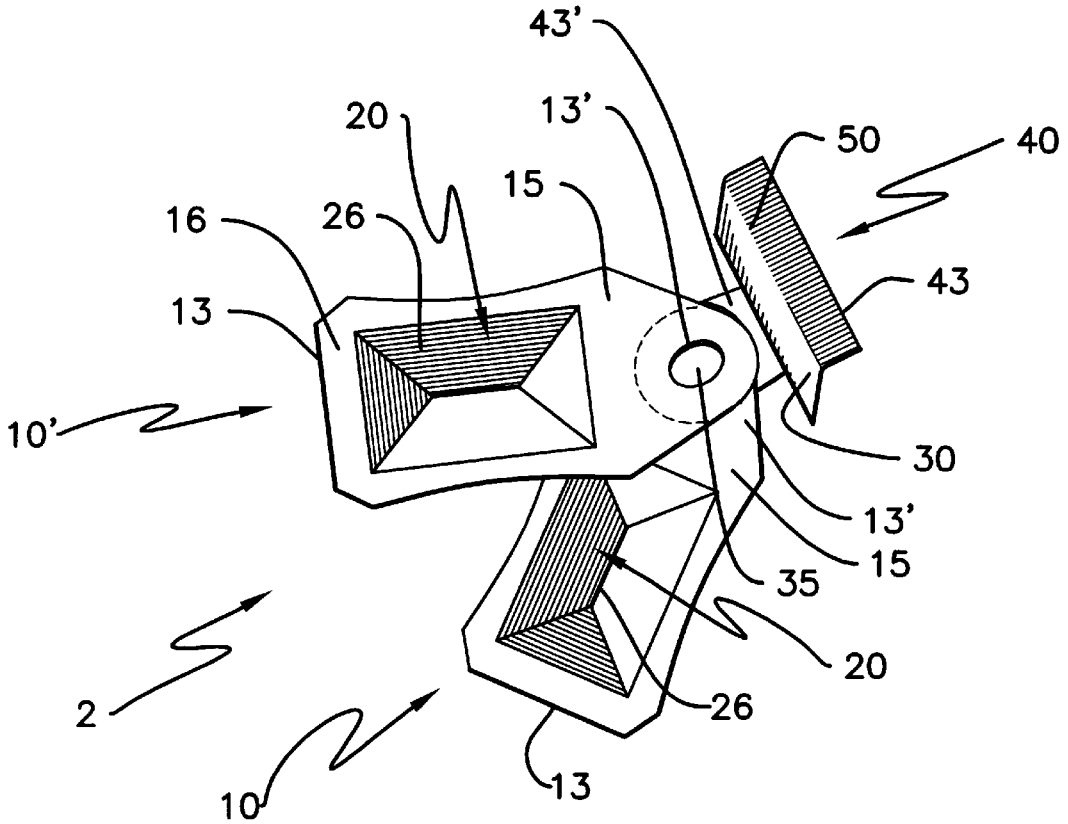
FIG. 12 is a perspective of an alternative embodiment of that shown in FIG. 2 wherein the muntin bar clip 2 has a plurality of posts 10, 10'. The respective posts 10, 10' have post ends 13 with post end bevels 14 and post surfaces 15 having first and second sides 16, 17; fastener means 20, formed at the post surface 15 from the first to the second side 16, 17, forming dimples 26; post second ends 13' distal from the post ends 13. Tip 40 having a tip end 43 distal from the post ends 13 terminating in a blunt end 50; the tip 40 having a tip second end 43' distal from the tip end 43. An offset 30 formed intermediate the tip 40 and the tip second end 43'. Connecting means 35 connecting post 10, 10' and the tip 40 at the post second ends 13' and the tip second end 43' such that post 10, 10' and the tip 40 are rotatably secured by the connecting means providing a swivel function.

Another embodiment of the disclosure is shown at FIG. 12 wherein muntin bar clip 2 has a plurality of posts 10, 10' affixed by connecting means to tip 40 and is utilized for the positioning of more than one false hollow muntin bars 65 where the false hollow muntin bars 65 will be other than orthogonal relative to the perimeter 72.

Figure 13:
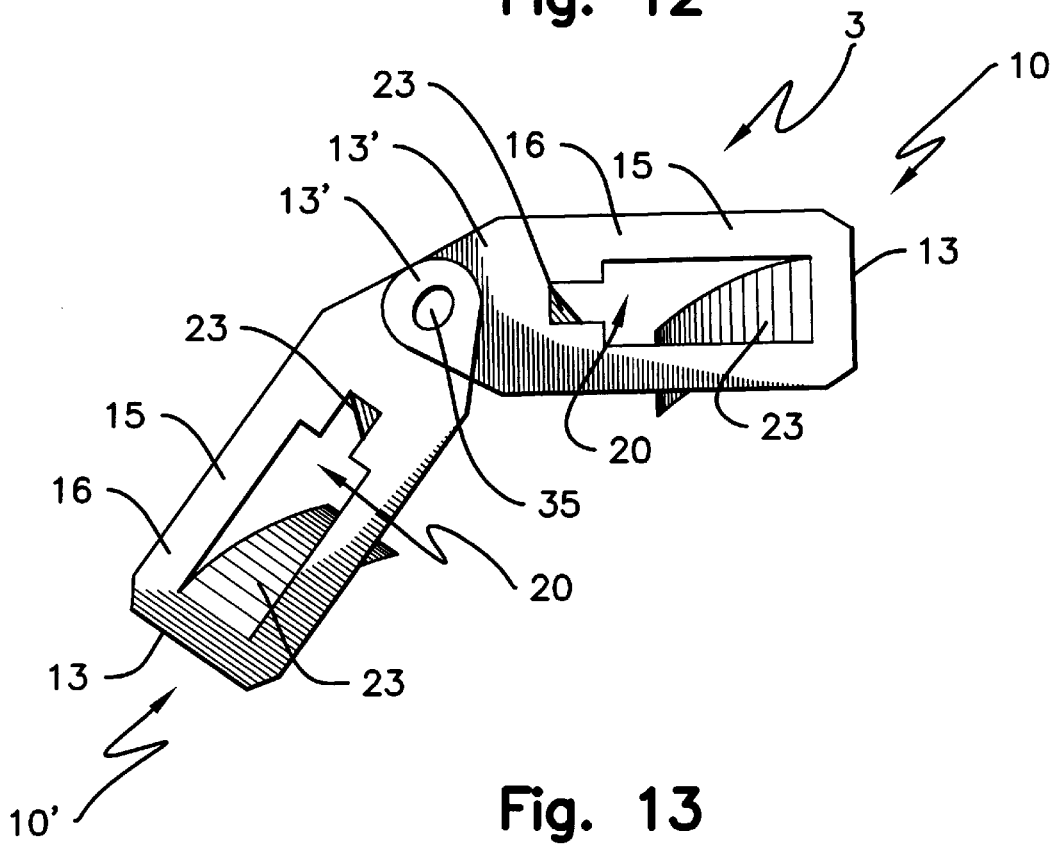
FIG. 13 is a perspective of another embodiment of a muntin bar clip 3 having a plurality of post 10, 10' and suggestive of embodiments of the invention having a plurality of posts. The respective posts 10, 10' have post ends 13 with post end bevels 14 and post surfaces 15 having first and second sides 16, 17; fastener means 20, formed at the post surface 15 from the first to the second side 16, 17, forming dimples 26; post second ends 13' distal from the post ends 13. Connecting means 35 connecting post 10, 10' at the post second ends 13' such that post 10, 10' are rotatably secured by the connecting means providing a swivel function.

An additional embodiment of the disclosure is shown at FIG. 13 wherein muntin bar clip 3 is utilized for the interconnection of and positioning of more than one false hollow muntin bar 65 for the formation of patterns. In this embodiment a plurality of posts 10, 10' having post ends and second ends 13, 13' and post surfaces 15 having a first and second side 16, 17. The posts 10, 10' will be fastened together by connecting means 35 including swivel means proximal to the second ends 13, 13'. The connecting means 35 may be a rivet providing a swivel function. FIG. 13 illustrates a fastener means 20 formed in the posts 10, 10' at the post surfaces 15 from the first to the second sides 16, 17. The fastener means 20 formed having one or a plurality of tang springs 23, the tang springs 23 having a spring function realized from the material from which the muntin bar clip 3 is manufactured, formed by a cutting or stamping means of the post surface 15 from the first to the second side 16, 17, or as a dimple 26, as shown in FIG. 12, formed generally by a stamping means of the post surfaces 15 by deforming the post surfaces 15 from the first to the second sides 16, 17. The tang springs 23 or the dimple 26, formed into a protrusion, are dimensioned to be friction received tightly into the aperture 66 of a false hollow muntin bar 65, having ends 68, at an end 68. Post bevels 14 may be featured in any embodiment of the invention. FIG. 13 demonstrates an embodiment having two posts, 10, 10'; it will be recognized that a plurality of posts may be connected as required by the number of muntin bars to be interconnected.

Figure 14:
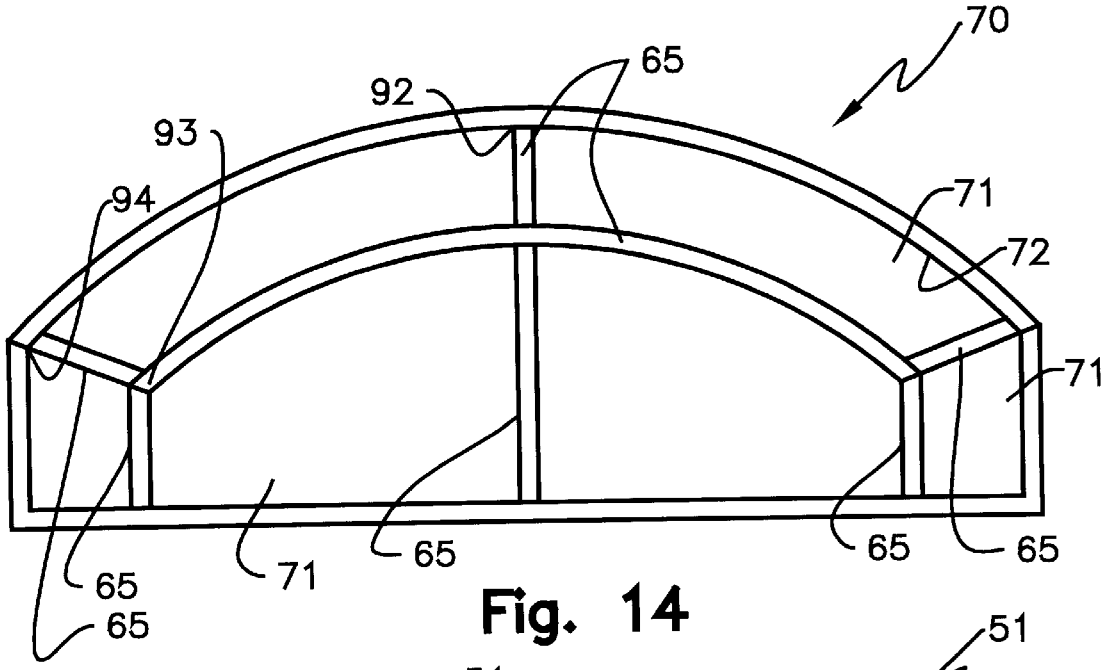
FIG. 14 is illustrative of a multi-pane sealed window unit 70 presenting a hollow false muntin bar 65 pattern permitting the use of muntin bar clip 1 as shown in FIG. 1 at the first intersection 92, muntin bar clip 3 as shown in FIG. 13 at the second intersection 93 and muntin bar hub 51 with muntin bar clip 1, as shown in FIG. 2, at the third intersection 94.

FIG. 14 is illustrative of a multi-pane sealed window unit 70 presenting a hollow false muntin bar 65 pattern permitting the use of muntin bar clip 3 having a plurality of posts as suggested by FIG. 13, at the first, second and third intersection 92, 93 and 94.

Figure 15:
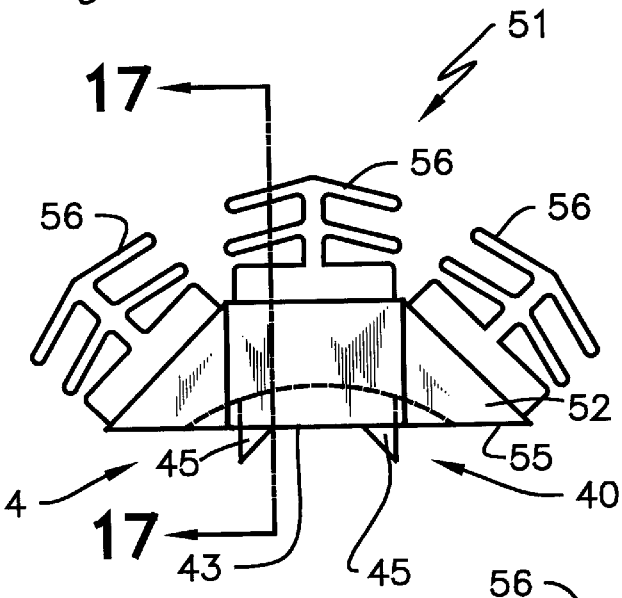
FIG. 15 is an elevation view of a muntin bar hub 51 having a hub 52 with a first and a second edge 53, 55; one or a plurality of muntin bar connection means 58 at the first edge 53 receiving muntin bar clip means 56; a slot 57 positioned at the second edge 55; a muntin bar clip 4 with a post 10, a post end 13 and a post surface 15; a fastener means 20 at the post surface 15; a tip 40 having a tip end 43 distal from the post end 13 terminating in one or a plurality of prongs 45; an offset 30 formed intermediate the tip 40 and the fastener means 20; the post 10 at the post end 13 received into the slot 57; the slot 57 positioned so that the tip 40 and one or a plurality of prongs 45 is received between a pane 71 and sealing structure 80.
Figure 16:
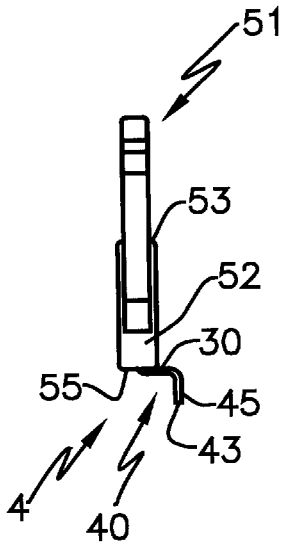
FIG. 16 is an elevation view of FIG. 15 illustrating the muntin bar hub 51 showing the hub 52, first edge 53, muntin bar clip means 56; illustrated is the muntin bar clip 4 with tip 40 having a tip end 43 terminating in one or a plurality of prongs 45 and an offset 30.
Figure 17:
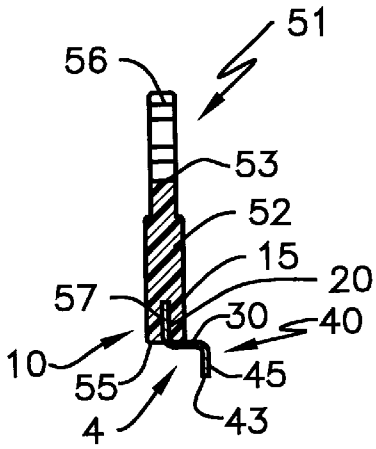
FIG. 17 is a section from FIG. 15 showing the muntin bar hub 51, hub 52, first and second edge 53, 55, muntin bar connection means 58, muntin bar clip means 56; illustrated is the muntin bar clip 4 with post 10, post end 13, post surface 15, fastener means 20 at the post surface 15; an offset 30 and tip 40 having a tip end 43 terminating in one or a plurality of prongs 45 which are received between a pane 71 and sealing structure 80.
Figure 18:
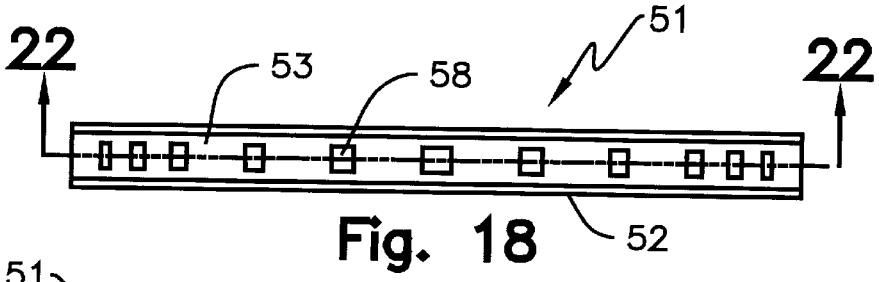
FIG. 18 is a top plan view illustrating a muntin bar hub 51 showing the hub 52, first edge 53, and muntin bar connection means 58, in the form of apertures.
Figure 19:
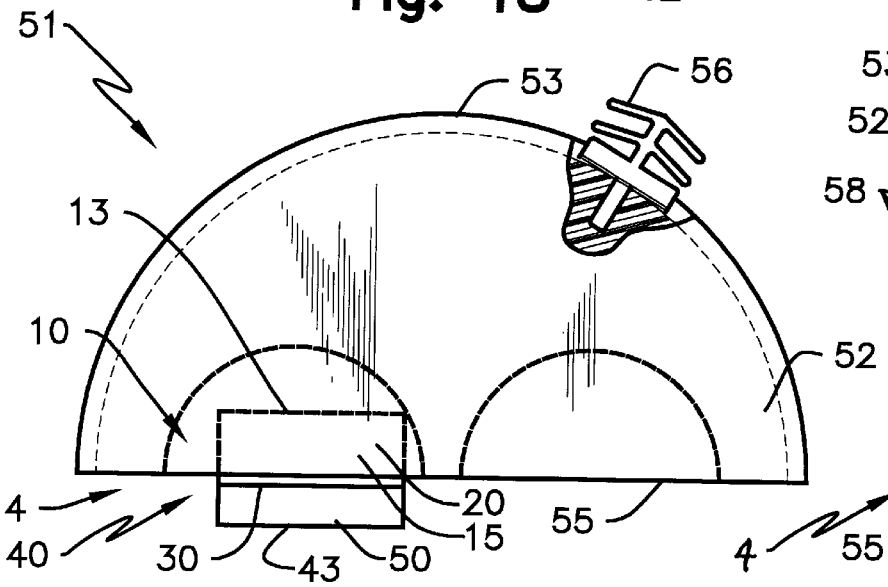
FIG. 19 is an elevation view of the muntin bar hub 51 having a hub 52 with a first and a second edge 53, 55; muntin bar clip means 56; a muntin bar clip 4 with a post 10, a post end 13 and a post surface 15; a fastener means 20 at the post surface 15; a tip 40 having a tip end 43, distal from the post end 13 terminating in a blunt end 50; an offset 30 formed intermediate the tip 40 and the fastener means 20; the tip 40 and blunt end 50 positioned to be received between a pane 71 and sealing structure 80.
Figure 20:
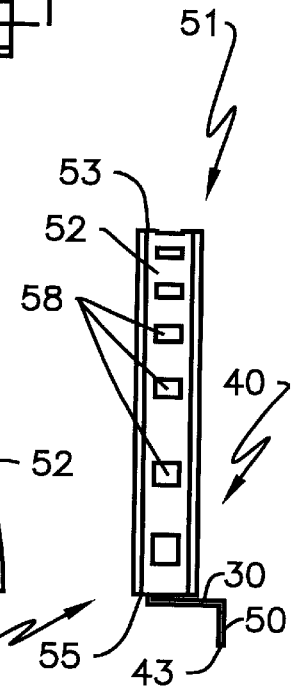
FIG. 20 is an elevation view of FIG. 19 illustrating the muntin bar hub 51 showing the hub 52, first edge 53, muntin bar connection means 58; illustrated is the muntin bar clip 4 with tip 40 having a tip end 43 terminating in a blunt end 50 and an offset 30; the tip 40 positioned so that the blunt end 50 is received between a pane 71 and sealing structure 80.
Figure 21:
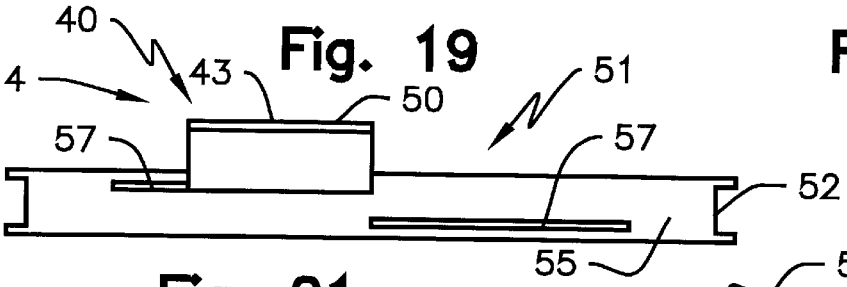
FIG. 21 is a bottom plan of the muntin bar hub 51, showing the hub 52, slots 57 positioned at the second edge 55; the muntin bar clip 4 with tip 40 showing the tip end 43 terminating in a blunt end 50.
Figure 22:
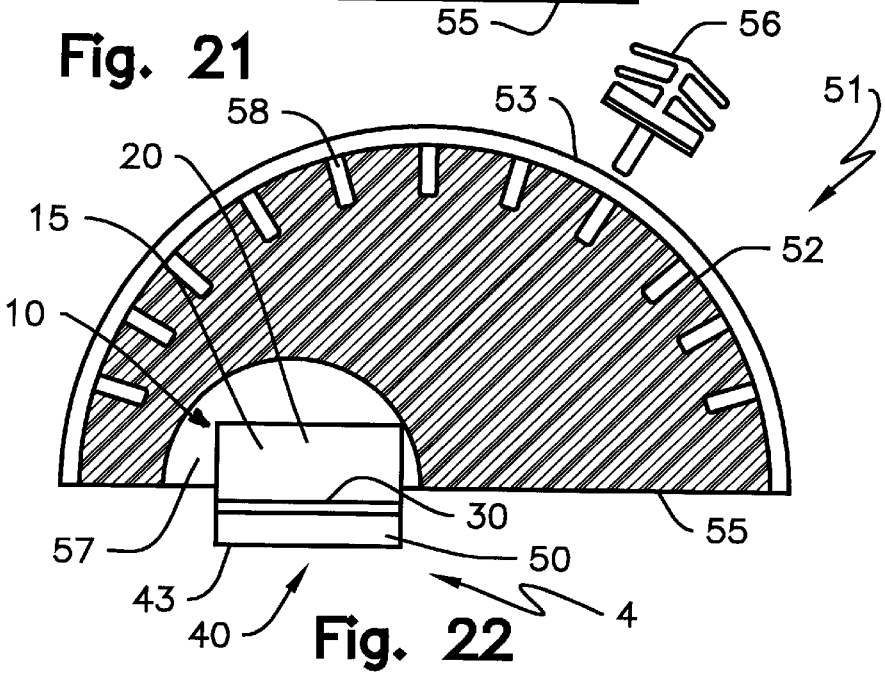
FIG. 22 is a section elevation view of the muntin bar hub 51 having a hub 52 with a first and a second edge 53, 55; muntin bar connection means 58 receiving muntin bar clip means 56; a muntin bar clip 4 with a post 10, a post end 13 and a post surface 15; a fastener means 20 at the post surface 15; a tip 40 having a tip end 43 distal from the post end 13 terminating in a blunt end 50; an offset 30 formed intermediate the tip 40 and the fastener means 20; the tip 40 and blunt end 50 positioned to be received between a pane 71 and sealing structure 80.

FIG. 15 through 17 demonstrate the embodiment of a muntin bar hub 51 having a hub 52 with a first and a second edge 53, 55; one or a plurality of muntin bar connection means 58 affixed at the first edge 53. The muntin bar connection means 58, in the form of an aperture, receives a muntin bar clip means 56 which is received into and provides a friction fit securing the hollow false muntin bar 65 from deviating from the desired orientation relative to a perimeter 72. Illustrated is a slot 57 positioned at the second edge 55 receiving a muntin bar clip 4 with a post 10, a post end 13 and a post surface 15; a fastener means 20 at the post surface 15; a tip 40 having a tip end 43 distal from the post end 13 terminating in one or a plurality of prongs 45; an offset 30 formed intermediate the tip 40 and the fastener means 20; the tip 40 and one or a plurality of prongs 45 positioned to be received between a pane 71 and sealing structure 80. The fastener means 20 of muntin bar clip 4 may be simply the sizing of the post 10 to insure a friction fit of the post 10 as received, at the post end 13, by the slot 57. Additionally, the fastener means 20 may take the form as demonstrated for muntin bar clip 1 in FIG. 1 or FIG. 2. It is also recognized that the tip 40 may be formed with either a blunt end 50 or with one or a plurality of prongs 45.

An additional embodiment is depicted in FIGS. 18, 19, 20, 21 and 22 illustrating the muntin bar hub 51 having a hub 52 with a first and a second edge 53, 55; muntin bar connection means 58 receiving muntin bar clip means 56; a muntin bar clip 4 with a post 10, a post end 13 and a post surface 15; a fastener means 20 at the post surface 15; a tip 40 having a tip end 43 distal from the post end 13 terminating in a blunt end 50; an offset 30 formed intermediate the tip 40 and the fastener means 20; the tip 40 and blunt end 50 positioned to be received between a pane 71 and sealing structure 80. The fastener means 20 of muntin bar clip 4 may be simply the sizing of the post 10 to insure a friction fit of the post 10 as received, at the post end 13, by the slot 57. Additionally, the fastener means 20 may take the form as demonstrated for muntin bar clip 1 in FIG. 1 or FIG. 2. It is also recognized that the tip 40 may be formed with either a blunt end 50 or with one or a plurality of prongs 45.

Figure 23:
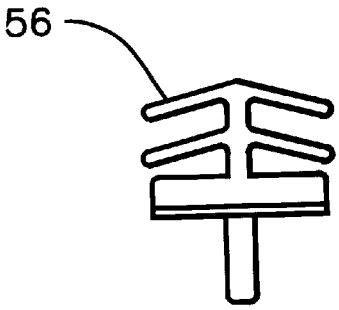
FIG. 23 is illustrative of a plan view of a muntin bar clip means 56 employed with the muntin bar hub 51 embodiment.
Figure 24:
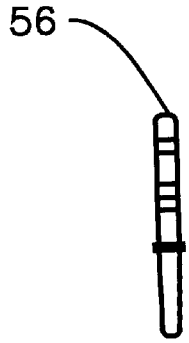
FIG. 24 is illustrative of a side plan view of muntin bar clip means 56 employed with the muntin bar hub 51 embodiment.

FIGS. 23 and 24 illustrate muntin bar clip means 56 for use with muntin bar hub 51 as shown in FIGS. 15–17 and 18–22.

Figure 1A:
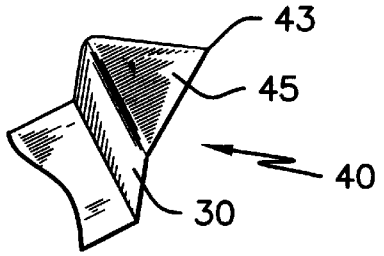
FIG. 1A is a perspective of an alternative embodiment of the tip 40 of the muntin bar clip 1 shown in FIG. 1 wherein the tip end 43 terminates in one prong 45.
Figure 25:
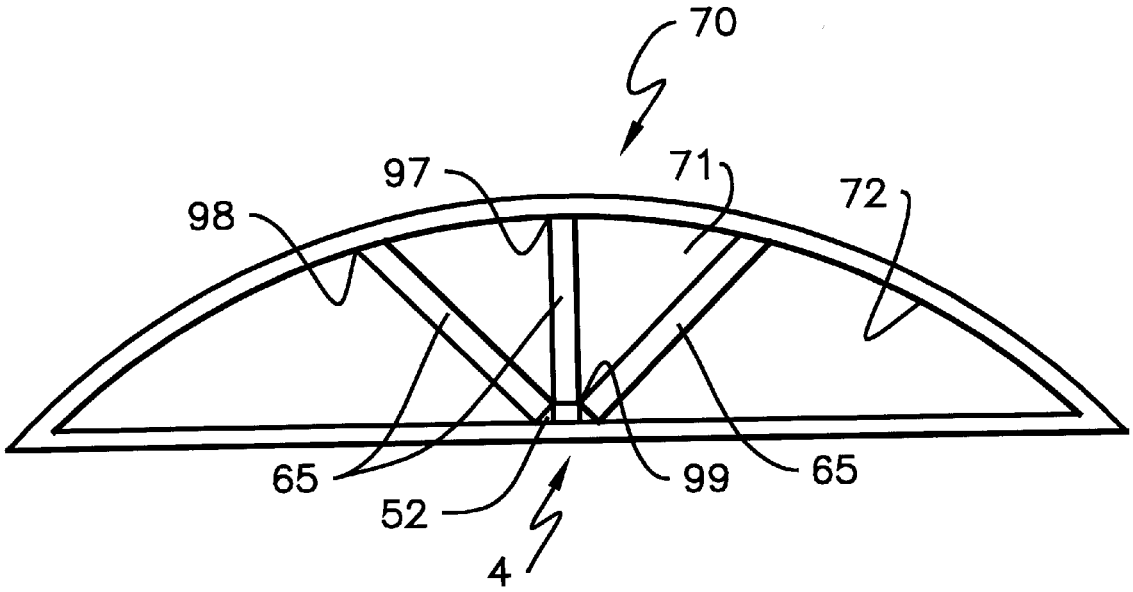
FIG. 25 is illustrative of a multi-pane sealed window unit 70 presenting a hollow false muntin bar 65 pattern permitting the use of muntin bar clip 1 as shown in FIGS. 1 and 1A, a fourth intersection 97; muntin bar clip 1 as shown in FIGS. 2, 3 and 4, at fifth intersection 98; and muntin bar hub 51, hub 52 and muntin bar clip 4, as shown in FIGS. 15 through 17, at sixth intersection 99.

FIG. 25 illustrates a multi-pane sealed window unit 70 presenting a hollow false muntin bar 65 pattern permitting the use of muntin bar clip 1 as shown in FIGS. 1 and 1A, at fourth intersection 97; muntin bar clip 1 as shown in FIGS. 2, 3 and 4, at fifth intersection 98; and muntin bar hub 51, as shown in FIGS. 15 through 17 at sixth intersection 99.

The muntin bar clip 1, 2, 3 or 4, as shown in FIGS. 1 through 13, 15–17, and 19–22 may be formed from a material capable of formation by stamping or cutting including, for example, sheet metal. The muntin bar clip 1 and 4, of FIG. 1 and FIGS. 15–17 and 19–22, including tip 40 and post 10, may be formed from a single unit of material. Muntin bar clips 2 and 3 are formed from multiple units of material, including for example sheet metal.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A muntin bar clip comprising:

A. a post having a post end, a post surface having a first and second side, fastener means formed as a dimple formed in the post at the post surface from the first to the second side;

B. a tip having a tip end distal from the post end; an offset formed intermediate the tip and the fastener means.

2. A window with a muntin bar clip comprising:

A. a muntin bar clip comprises a post having a post end, a post surface having a first and second side, fastener means formed as a tang fastener having one or a plurality of tang springs; the post end has post end bevels;

B. a tip having a tip end distal from the post end; an offset formed intermediate the tip and the fastener means; the tip end terminate in one or a plurality of prongs;

C. a false hollow muntin bar has an end and an aperture; the aperture receives at the end the post, at the post end;

D. a multi-pane sealed window unit having panes and a perimeter; a sealing structure at the perimeter; hollow false muntin bars received between the panes; the tip end is dimensioned to be secured between a pane and into the sealing structure;

E. the offset is dimensioned to center and securely position the false hollow muntin bar between the panes when the post is received and secured into the false hollow muntin bar aperture at an end and the tip end is received between a pane and into the sealing structure at the perimeter.

3. A window with a muntin bar clip according to claim 1 wherein said:

A. the post end has post end bevels;

B. the tip end terminates in a blunt end;

C. a false hollow muntin bar has an end and an aperture; the aperture receives at the end the post, at the post end;

D. a multi-pane sealed window unit having panes and a perimeter; a sealing structure at the perimeter; hollow false muntin bars received between the panes; the tip end is dimensioned to be secured between a pane and into the sealing structure;

E. the offset is dimensioned to center and securely position the false hollow muntin bar between the panes when the post is received and secured into the false hollow muntin bar aperture at an end and the tip end is received between a pane and into the sealing structure at the perimeter.

4. The muntin bar clip of claim 2 wherein:

A. the tang springs have a spring function.

5. A muntin bar clip comprising:

A. a post having a post end and a post second end distal from the post end; fastener means formed as a tang fastener formed in the post at a post surface from the first to the second side intermediate the post end and post second end;

B. a tip has a tip end and a tip second end distal from the tip end; the tip having an offset intermediate the tip end and tip second end;

C. connecting means is positioned intermediate the post second end and the fastener means and the tip second end and the offset such that the post and the tip are rotatably secured.

6. A muntin bar clip of claim 5 where the connecting means is a swivel means; the tip end terminates in one or a plurality of prongs.

7. A muntin bar clip of claim 5 where the connecting means is a swivel means; the tip end terminates in a blunt end.

8. A window with a muntin bar clip comprising:

A. a plurality of posts each having a post end and a post second end distal from the post end; fastener means formed as at least one tang fastener having a spring function in each post at a post surface from a first to a second side intermediate the post end and post second end;

B. a tip has a tip end and a tip second end distal from the tip end; the tip having an offset intermediate the tip end and tip second end;

C. connecting means is positioned intermediate each post second end and the fastener means and the tip second end and the offset such that the plurality of posts and the tip are rotatably secured;

D. a false hollow muntin bar has an end and an aperture; the aperture receives at the end the post, at the post end;

E. a multi-pane sealed window unit having panes and a perimeter; a sealing structure at the perimeter; hollow false muntin bars received between the panes; the tip end is dimensioned to be secured between a pane and into the sealing structure;

F. the offset is dimensioned to center and securely position the false hollow muntin bar between the panes when the post is received and secured into the false hollow muntin bar aperture at an end and the tip end is received between a pane and into the sealing structure at the perimeter.

9. A window with a muntin bar clip comprising:

A. a plurality of posts each having a post end and a post second end distal from the post end; the fastener means formed as a dimple in each post at a post surface from a first to a second side intermediate the post end and post second end into a protrusion dimensioned to be friction received tightly into an aperture of a false hollow muntin bar, having ends, at an end;

B. a tip has a tip end and a tip second end distal from the tip end; the tip having an offset intermediate the tip end and tip second end;

C. connecting means is positioned intermediate each post second end and the fastener means and the tip second end and the offset such that the plurality of posts and the tip are rotatably secured;

D. a false hollow muntin bar has an end and an aperture; the aperture receives at the end the post, at the post end;

E. a multi-pane sealed window unit having panes and a perimeter; a sealing structure at the perimeter; hollow false muntin bars received between the panes; the tip end is dimensioned to be secured between a pane and into the sealing structure;

F. the offset is dimensioned to center and securely position the false hollow muntin bar between the panes when the post is received and secured into the false hollow muntin bar aperture at an end and the tip end is received between a pane and into the sealing structure at the perimeter.

10. A muntin bar clip according to claim 1 wherein:

A. the tip end terminates in one or a plurality of prongs.

11. A method of using the muntin bar clip of claim 10 comprising the steps of:

A. inserting the fastener means into a muntin bar;

B. positioning the prongs so that the tip end is received between a pane and into a sealing structure of a multi-pane sealed window unit.

12. A muntin bar clip according to claim 1 wherein:

A. the tip end terminates in a blunt end.

13. A muntin bar clip comprising:

A. a plurality of posts each having a post end and a post second end distal from the post end; fastener means formed as a dimple formed in each post at a post surface from a first to a second side intermediate the post end and post second end;

B. connecting means is positioned intermediate each post second end and the fastener means such that the plurality of posts are rotatably secured.

14. A muntin bar clip comprising:

A. a post having a post end and a post second end distal from the post end; fastener means formed as a dimple formed in the post at a post surface from the first to the second side intermediate the post end and post second end;

B. a tip has a tip end and a tip second end distal from the tip end; the tip having an offset intermediate the tip end and tip second end;

C. connecting means is positioned intermediate the post second end and the fastener means and the tip second end and the offset such that the post and the tip are rotatably secured.

15. A muntin bar clip of claim 14 where the connecting means is a swivel means; the tip end terminates in one or a plurality of prongs.

16. A muntin bar clip of claim 14 where the connecting means is a swivel means; the tip end terminates in a blunt end.

* * * * *